US005327108A

United States Patent [19]

Hoang et al.

[11] Patent Number: 5,327,108

[45] Date of Patent: Jul. 5, 1994

[54] SURFACE MOUNTABLE INTERDIGITAL BLOCK FILTER HAVING ZERO(S) IN TRANSFER FUNCTION

[75] Inventors: Truc G. N. Hoang, San Diego, Calif.; Darren V. Weninger, Maize, Kans.

[73] Assignee: Motorola, Inc., Schaumburg, Ill.

[21] Appl. No.: 178,350

[22] Filed: Jan. 6, 1994

Related U.S. Application Data

[63] Continuation of Ser. No. 962,622, Oct. 16, 1992, abandoned, which is a continuation of Ser. No. 667,844, Mar. 12, 1991, abandoned.

[51] Int. Cl.[5] ..... H01P 1/205

[52] U.S. Cl. ..... 333/203; 333/206

[58] Field of Search ..... 333/202, 203, 206, 207, 333/222

[56] References Cited

U.S. PATENT DOCUMENTS

| | | | |
|---|---|---|---|
| 4,431,977 | 2/1984 | Sokola et al. | 333/206 |
| 4,523,162 | 6/1985 | Johnson | 333/203 X |
| 4,673,902 | 6/1987 | Takeda et al. | 333/202 |
| 4,757,284 | 7/1988 | Ueno | 333/203 |
| 4,806,889 | 2/1989 | Nakano et al. | 333/206 X |
| 4,879,533 | 11/1989 | deMuro et al. | 333/206 |
| 4,896,124 | 1/1990 | Schwent | 333/206 |
| 4,954,796 | 9/1990 | Green et al. | 333/206 |
| 5,045,824 | 9/1991 | Metroka | 333/202 X |

FOREIGN PATENT DOCUMENTS

| | | | |
|---|---|---|---|
| 0189001 | 8/1986 | Japan | 333/202 |
| 0038601 | 2/1987 | Japan | 333/202 |
| 0154801 | 7/1987 | Japan | 333/202 |
| 0306701 | 12/1988 | Japan | 333/202 |

*Primary Examiner*—Seungsook Ham
*Attorney, Agent, or Firm*—Darleen J. Stockley

[57] ABSTRACT

Interdigitation and surface mounting of a block filter that has at least a first resonator and that has at least a first pole and at least a first zero in its transfer function provides a surface mountable block filter having selectable frequency rejection response operation.

15 Claims, 2 Drawing Sheets

SURFACE MOUNTABLE INTERDIGITAL BLOCK FILTER HAVING ZERO(S) IN TRANSFER FUNCTION

This is a continuation of application Ser. No. 07/962,622, filed Oct. 16, 1992 and now abandoned which is a continuation of application Ser. No. 07/667,844, filed Mar. 12, 1991 and now abandoned.

This application is related to the application filed concurrently herewith: Surface Mountable Interdigital Block Filter (Ser. No. 07/667,841); Truc Giang-Nguyen Hoang, Inventor; Motorola Inc., Assignee.

FIELD OF THE INVENTION

The present invention is generally related to electrical signal filters, and more particularly to surface mountable block filters.

BACKGROUND OF THE INVENTION

As mobile and portable radios and electrical devices have decreased in size, transceivers and filters utilized therein have been modified to be more space efficient. Surface mountable filters that mount directly to a substrate have been utilized to reduce electrical component space requirements. Typically, a transfer function of a block filter component is associated with operating characteristics of that block filter. In theory, the transfer function typically may have a numerator with roots that are termed zeros, and a denominator with roots that are termed poles. However, surface mountable block filters have previously failed to include filters having transfer functions with zeros, lacking selectable frequency rejection response characteristics. There is a need for a surface mountable block filter that, while utilizing a transfer function with at least one pole, simultaneously provides for selectable frequency rejection response operation.

SUMMARY OF THE INVENTION

A surface mountable interdigital block filter for filtering electrical signals is provided that has at least a first pole and at least a first zero in its frequency transfer function and that is substantially directly mountable on a conductive surface of a substrate, the filter comprising at least:

a volume of dielectric material having at least a first and a second surface, substantially arranged to provide at least:

three apertures, arranged and operably coupled to substantially provide at least:

a first conductive interdigitated resonator means, extending from the first surface of the volume of dielectric material to the second surface of the volume of dielectric material, utilizing a primary aperture formed in the volume of dielectric material for each conductive resonator, primary apertures being substantially coaxial, extending from the first surface of the volume of dielectric material to the second surface of the volume of dielectric material, and each conductive resonator having conductive material disposed on an inner peripheral surface of the at least three primary apertures;

a conductive input unit and a conductive output unit, each operably coupled to at least a first conductive interdigitated resonator unit, for at least facilitating external conductive connections and at least allowing desired provision and extraction of electrical signals to and from selected conductive resonator means;

such that adjacent apertures substantially are at least alternately connected and unconnected to a ground respectively along the first surface and along the second surface; and conductive material disposed on at least part of the surfaces of the volume of dielectric material, substantially arranged to at least permit conductive surface mounting of the surface mountable interdigital block filter on the conductive surface of the substrate and to substantially provide an electrical signal filter that substantially provides for selectable frequency rejection response operation.

DETAILED DESCRIPTION OF A PREFERRED EMBODIMENT

Figure 1A:
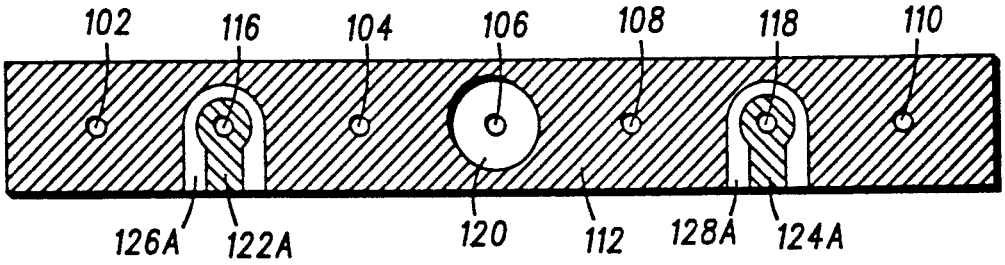
FIGS. 1A, 1B, and 1C, respectively, are schematics of a top view, a side view, and a bottom view, respectively, of a first embodiment of a surface mountable interdigital block filter in accordance with the present invention.
Figure 1B:
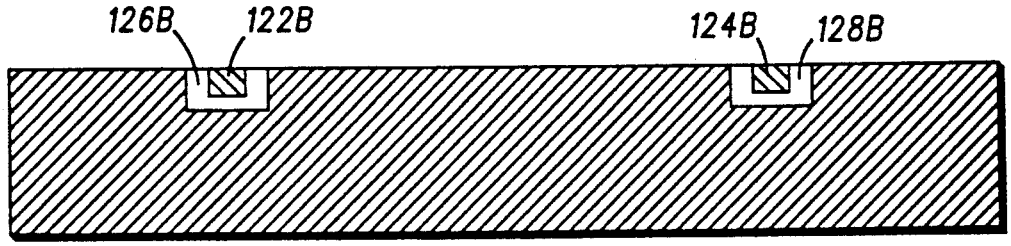
Figure 1C:
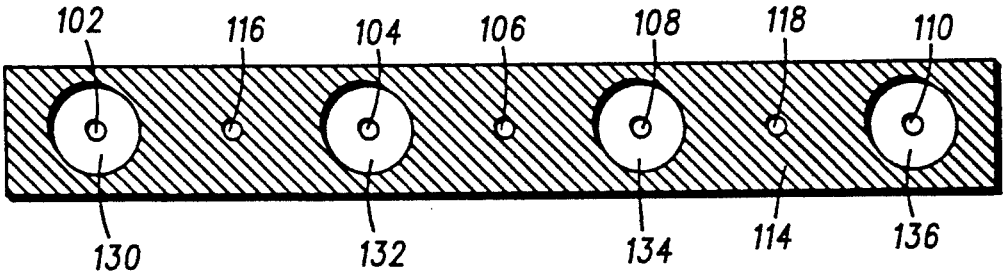

FIGS. 1A, 1B, and 1C, respectively, are schematics of a top view, a side view, and a bottom view, respectively, of a first embodiment of a surface mountable interdigital block filter in accordance with the present invention, wherein the block filter utilizes at least five conductive interdigitated resonators, each having a primary aperture (102, 104, 106, 108, 110, . . . ). The first embodiment of the surface mountable interdigital block filter comprises at least a volume of dielectric material, typically a parallelepiped, having at least a first surface (112) and a second surface (114), being opposing surfaces in a parallelepiped, substantially arranged to provide at least: seven apertures (102, 104, 106, 108, 110, 116, 118, . . . ), arranged and operably coupled by input and output line tapping to substantially provide at least: five conductive interdigitated resonators, each extending from the first surface (112) of the volume of dielectric material to the second surface (114) of the volume of dielectric material. Input and output line tapping is defined substantially as conductive connection of a first secondary aperture of a conductive input to a first primary aperture of a resonator end, and conductive connection of a second secondary aperture to a conductive output to a last primary aperture of a resonator end of the filter. Interdigitated means that adjacent resonator apertures are substantially alternately connected to ground. Interdigitation aids in reducing undesirable coupling between adjacent resonator apertures due to antenna-like radiation of radio signals from aperture ends.

Each interdigitated resonator utilizes a primary aperture (102, 104, 106, 108, 110, . . . ) formed in the volume of dielectric material for each conductive resonator, primary apertures (102, 104, 106, 108, 110 . . . ) being substantially coaxial, extending from the first surface (112) of the volume of dielectric material to the second surface (114) of the volume of dielectric material. Placement of primary apertures (102, 104, 106, 108, 110, . . . ) in the filter block and the spacing of adjacent primary apertures is selected to obtain desired electrical filtering characteristics.

Further, the volume of dielectric material includes at least two secondary apertures (116, 118, . . . ), apertures that are utilized for conductive input and conductive output, each conductive input and output extending from the first surface (112) of the volume of dielectric material to the second surface (114) of the volume of dielectric material, secondary apertures further being substantially coaxial. Each conductive input and conductive output (116, 118, . . . ) has a conductive layer formed on an inner peripheral surface of the at least two secondary apertures, for at least facilitating external conductive connections, each is operably connected to at least a first resonator, thereby allowing desired provision and extraction of electrical signals to and from selected conductive resonators.

Adjacent apertures substantially are at least alternately connected and unconnected to a ground respectively along the first surface (112) and along the second surface (114).

In the first embodiment, two zeros in the transfer function for the block filter are substantially obtained by placing a first conductive resonator, a conductive input secondary aperture (116), a second conductive resonator, a third conductive resonator, a fourth conductive resonator, a conductive output secondary aperture (118), and a fifth conductive resonator seriatim, interdigitated, in the volume of dielectric material, wherein a conductive resonator for a zero (for the first embodiment, the first conductive resonator and the fifth conductive resonator, respectively) has a first surface conductive material pattern and a second surface conductive material pattern that is one of: (one) substantially the same as a first surface conductive material pattern and a second surface material pattern of an adjacent conductive resonator for a pole (for the first embodiment, the second conductive resonator and the fourth conductive resonator, respectively) and (two) substantially reversed from a first surface conductive material pattern and a second surface conductive material pattern of an adjacent conductive input/output secondary aperture (for the first embodiment, the conductive input secondary aperture and the conductive output secondary aperture, respectively). Further zeros may be added, as desired by adding further conductive resonators next to existing zero conductive resonator apertures at a position away from a centermost portion of the filter block. Conductive resonators implemented for zeros differ from conductive resonators for poles in at least one of: aperture diameter, aperture length, and first surface and second surface conductor material patterns of a conductive resonator for a zero reversed from those of a conductive resonator for a pole.

Conductive material is substantially disposed on at least part of the surfaces of the volume of dielectric material, and is substantially arranged, typically by a conductive material first surface connection (122A, 124A) to the conductive input and output overlapped to a substantially perpendicular surface (122B, 124B) to at least permit conductive surface mounting of the surface mountable interdigital block filter on the conductive surface of the substrate and to substantially provide an electrical signal filter that is selectably frequency adjustable. Selected surface areas are typically not covered with conductive material (126A, 126B, 120, 128A, 128B, 130, 132, 134, 136) to allow input and output connections and to aid in interdigitation.

Figure 2:
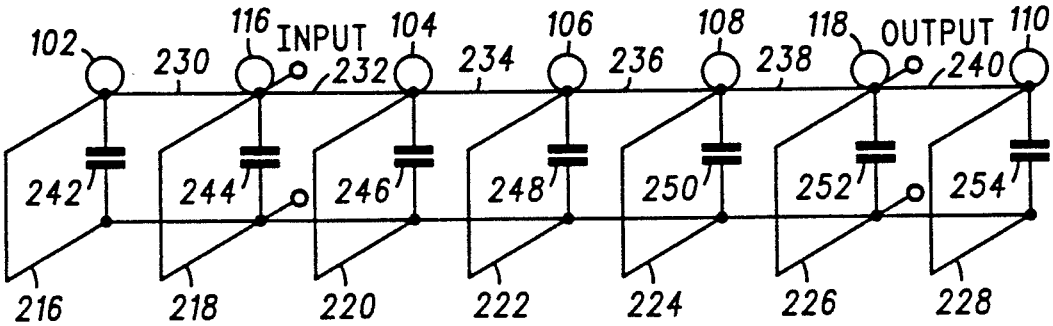
FIG. 2 is a schematic of a circuit diagram of the first embodiment of a block filter in accordance with the present invention.

FIG. 2 is a schematic of a circuit diagram of the first embodiment of a block filter in accordance with the present invention, wherein the block filter utilizes at least five conductive interdigitated resonators, each having a primary aperture (102,104, 106,.108, 118, 110, . . . ). The first embodiment has at least 7 apertures comprising at least five primary apertures that function as resonators (102, 104, 106, 108, 110), and at least two secondary apertures that function as an input and an output (116, 118). Typical capacitances are selectable. Transmission lines (216, 218, 220, 222, 224, 226, 228) represent the seven apertures. Physically, a permittivity (Er) of the block filter, a size of the aperture, and a location of the aperture in the filter block define operational characteristics of impedance (Z) for that aperture and the frequency of operation of the filter defines a resonator electrical length (LEN). Transmission lines (230, 232, 234, 236, 238, 240) represent an electrical coupling between adjacent apertures. Capacitors (242, 244, 246, 248, 250, 252, 254) represent electrical capacitances due to surface patterns of conductive material; these surface patterns are utilized to fine tune an operating frequency of the filter block, typically up or down by at least 100 MHz. Typical values for such capacitances (242, 244, 246, 248, 250, 252, 254) are usually less than 1.5 pF.

For example, a workable set of operational characteristics for a surface mountable interdigital block filter in accordance with the present invention is substantially: a substantially rectangular-sided parallelepiped, substantially 4.826 cm.×0.5334 cm.×height cm. (1.900 in.×0.210 in.×height in.) (LEN of resonators, height being frequency dependent) of dielectric material (Er substantially 37.3) having aperture spacing, as one approaches a center of a first surface of the volume of dielectric material from two opposing outer edges of the first surface, of edge to first aperture center of substantially 0.3556 centimeters (cm.) (0.14 inches (in.)), aperture center to aperture center of substantially 0.5461 cm. (0.215 in) for conductive input and output apertures to adjacent resonator aperture center, and aperture center to aperture center of substantially 0.6223 cm. (0.245 in.) for a next adjacent resonator aperture center to adjacent resonator aperture center, next adjacent resonator aperture center to adjacent resonator aperture center spacing of substantially 0.889 cm. (0.35 in), and substantially having capacitances (in pF) and impedances (in ohms):

14.52 ohms at a first aperture transmission line (216);
13.32 ohms at a second aperture transmission line (218);
12.54 ohms at a third aperture transmission line (220);
12.28 ohms at a fourth aperture transmission line (222);
12.54 ohms at a fifth aperture transmission line (224);
13.32 ohms at a fifth aperture transmission line (226);
14.52 ohms at a fifth aperture transmission line (228);
215.5 ohms at a first adjacent aperture coupling transmission line (230);
293.98 ohms at a second adjacent aperture coupling transmission line (232);

1419.32 ohms at a third adjacent aperture coupling transmission line (234);
1419.32 ohms at a fourth adjacent aperture coupling transmission line (236);
293.98 ohms at a third adjacent aperture coupling transmission line (238);
215.5 ohms at a fourth adjacent aperture coupling transmission line (240);
0.8 pF at a first surface pattern capacitance (242);
1.1 pF at a second surface pattern capacitance (244);
0.9 pF at a third surface pattern capacitance (246);
0.9 pF at a fourth surface pattern capacitance (248);
0.9 pF at a fifth surface pattern capacitance (250);
1.1 pF at a fourth surface pattern capacitance (252); and
0.8 pF at a fifth surface pattern capacitance (254).

Figure 3:
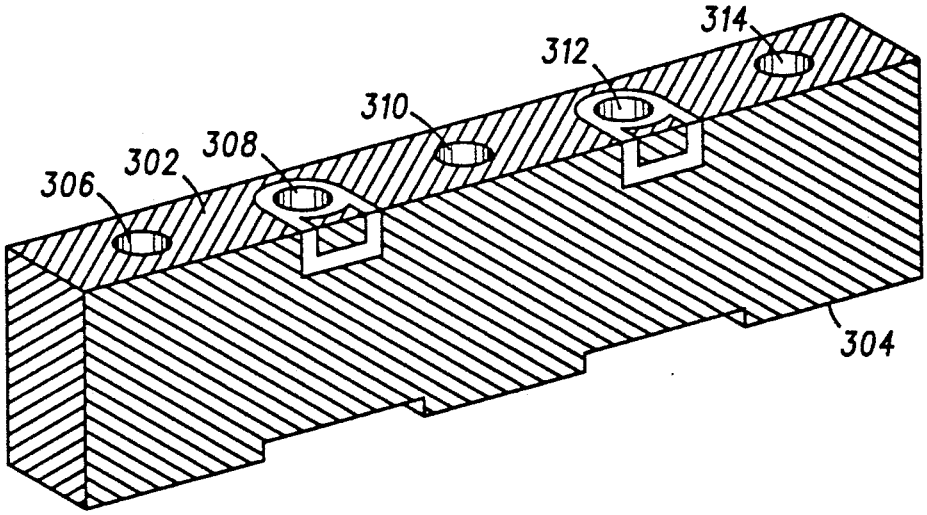
FIG. 3 is a schematic perspective view of a second embodiment of a surface mountable interdigital block filter in accordance with the present invention.

FIG. 3 is is a schematic perspective view of a second embodiment of a surface mountable interdigital block filter in accordance with the present invention, wherein capacitive conductive tapping is utilized for conductive input and conductive output. The second embodiment of the surface mountable interdigital block filter comprises at least a volume of dielectric material, typically a parallelepiped, having at least a first surface (302) and a second surface (304), being opposing surfaces in a parallelepiped, substantially arranged to provide at least: five apertures (306, 308, 310, 312, 314, . . . ), arranged and operably coupled by capacitive tapping, to substantially provide at least: five conductive interdigitated resonators, each extending from the first surface (302) of the volume of dielectric material to the second surface (304) of the volume of dielectric material. Capacitive tapping is defined substantially as placing a first conductor pad for input near a radiating end of a first primary aperture of a resonator and a second conductor pad for output near a radiating end of a second primary aperture of a last resonator for input and output connection. Each interdigitated resonator utilizes a primary aperture (306, 310, 314, . . . ) formed in the volume of dielectric material for each conductive resonator, primary apertures (306, 310, 314, . . . ) being substantially coaxial, extending from the first surface (302) of the volume of dielectric material to the second surface (304) of the volume of dielectric material. Placement of primary apertures (306, 310, 314, . . . ) in the filter block and the spacing of adjacent primary apertures is selected to obtain desired electrical filtering characteristics.

Further, the volume of dielectric material includes at least two secondary apertures (308, 312, . . . ), apertures that are utilized for conductive input and conductive output, each conductive input and output extending from the first surface (302) of the volume of dielectric material to the second surface (304) of the volume of dielectric material, secondary apertures further being substantially coaxial. Each conductive input and conductive output aperture (308, 312 . . . ) has a conductive layer formed on an inner peripheral surface of the at least two secondary apertures, for at least facilitating external conductive connections, each is operably connected by capacitive tapping to at least a first resonator, thereby allowing desired provision and extraction of electrical signals to and from selected conductive resonators.

Adjacent apertures substantially are at least alternately connected and unconnected to a ground respectively along the first surface (302) and along the second surface (304).

In the second embodiment, two zeros in the transfer function for the block filter are substantially obtained by placing a first conductive resonator, a conductive input secondary aperture (308), a second conductive resonator, a conductive output secondary aperture (312), and a third conductive resonator seriatim, interdigitated, in the volume of dielectric material, wherein conductive resonators implemented for zeros differ from conductive resonators for poles in at least one of: aperture diameter, aperture length, and first surface and second surface conductor material patterns of a conductive resonator for a zero reversed from those of a conductive resonator for a pole, and wherein a conductive resonator for a zero (for the second embodiment, the first conductive resonator and the third conductive resonator, respectively) has a first surface conductive material pattern and a second surface conductive material pattern that is one of: (one) substantially the same as a first surface conductive material pattern and a second surface material pattern of an adjacent conductive resonator for a pole (for the second embodiment, the second conductive resonator) and (two) substantially reversed from a first surface conductive material pattern and a second surface conductive material pattern of an adjacent conductive input/output secondary aperture (for the second embodiment, the conductive input secondary aperture and the conductive output secondary aperture, respectively). Further zeros may be added, as desired by adding further conductive resonators next to existing zero conductive resonator apertures at a position away from a centermost portion of the filter block. Conductive resonators implemented for zeros differ from conductive resonators for poles in at least one of: aperture diameter, aperture length, and first surface and second surface conductor material patterns of a conductive resonator for a zero reversed from those of a conductive resonator for a pole.

Conductive material is substantially disposed as described for the first embodiment.

Figure 4:
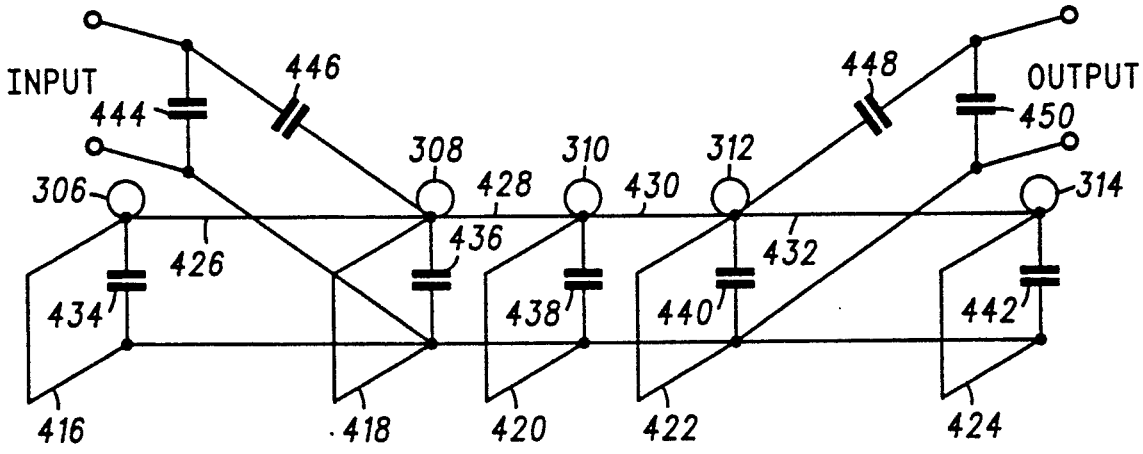
FIG. 4 is a schematic of a circuit diagram of the second embodiment of a block filter in accordance with the present invention.

FIG. 4 is a schematic of a circuit diagram of the second embodiment of a block filter in accordance with the present invention, wherein the block filter utilizes at least three conductive interdigitated resonators, each having a primary aperture (306, 310, 314, . . . ). The second embodiment has at least 5 apertures (306, 308, 310, 312, 314, . . . ) comprising at least three primary apertures that function as resonators (306, 310, 314), and at least two secondary apertures that function as an input and an output (308, 312, . . . ). Typical capacitances are selectable. Transmission lines (416, 418, 420, 422, 424) represent the five apertures. Physically, a permittivity (Er) of the block filter, a size of the aperture, and a location of the aperture in the filter block define operational characteristics of impedance (Z) for that aperture and the frequency of operation of the filter defines a resonator electrical length (LEN). Transmission lines (426, 428, 430, 432) represent an electrical coupling between adjacent apertures. Capacitors (444, 446, 448, 450) represent capacitances due to input and output connections, respectively. Capacitors (434, 436, 438, 440, 442) represent electrical capacitances due to surface patterns of conductive material; these surface patterns are utilized to fine tune an operating frequency of the filter block, typically up or down by at least 100 MHz. Typical values for such surface pattern capacitances (434, 436, 438, 440, 442) are usually less than 1.5 pF.

The present invention provides a surface mountable interdigital block filter that provides for selectable frequency rejection response operation in a compact unit, thereby facilitating construction of smaller devices, such as radios, that utilize electrical signal filters.

We claim:

1. A surface mountable interdigital block filter for filtering electrical signals, the block filter being substantially directly mountable on a conductive surface of a substrate, comprising:

a substantially parallelepiped volume of dielectric material having at least a first and a second surface. substantially arranged to provide;

at least three primary apertures extending coaxially from said first and Second surfaces and having conductive material disposed on an inner surface of said apertures to provide conductive resonator means, input and output secondary apertures extending coaxially from said first and second surfaces and having conductive material disposed on an inner surface of said secondary apertures to provide conductive resonator means, for at least facilitating external conductive connections and at least allowing desired provision and extraction of electrical signals, wherein the secondary apertures are operably coupled to the primary apertures and the apertures are arranged in an order of:

a first primary aperture, the input secondary aperture, a second primary aperture, any primary apertures selected in addition to the three primary apertures, the output secondary aperture and a third primary aperture, a first conductive line is utilized for input into the input secondary aperture and a second conductive line is utilized for output from the output secondary aperture, wherein adjacent apertures are at least alternately connected and unconnected to a ground respectively along the first surface and along the second surface such than said conductive resonator means are interdigitated; and conductive material is disposed on at least Dart of the surfaces of the volume of dielectric material, substantially arranged to at least permit conductive surface mounting of the surface mountable interdigital block filter on the conductive surface of the substrate and to provide an electrical signal filter that provides for selectable frequency rejection response operation wherein the input and output secondary apertures are utilized, respectively, to radiate and receive signals to and from adjacent conductive interdigitated resonator(s) means, wherein said conductive interdigitated resonator means are constructed and arranged such that the block filter has at least a first pole and at least a first zero in its frequency transfer function provided by at least a first resonator that is utilized for zero(s) of a frequency transfer function, and wherein the input and output secondary apertures have a length that is different from the length of the primary apertures.

2. The surface mountable interdigital block filter of claim 1, wherein the conductive material disposed on the dielectric volume includes at least a wrap-around conductor pattern on at least the first surface of the dielectric volume and around the input and output secondary apertures at the first surface for facilitating conductive connection of the surface mountable interdigital block filter to the conductive surface of the substrate.

3. The surface mountable interdigital block filter of claim 1, wherein the first surface and the second surface of the volume of dielectric material are opposing surfaces and wherein each conductive resonator means substantially comprises a resonator whose length extends between first and second surfaces.

4. The surface mountable interdigital block filter of claim 1, wherein the conductive material includes silver.

5. The surface mountable interdigital block filter of claim 1, wherein said first conductive line and said second conductive line are comprised of a first conductor pad and a second conductor pad, respectively, and said first and second conductor pads are located proximate to a radiating end of said input and output secondary apertures, respectively.

6. A surface mountable interdigital block filter for utilizing resonators for zero(s) in a frequency transfer function for filtering electrical signals, the block filter being substantially directly mountable on a conductive surface of a substrate, comprising:

a substantially parallelepiped volume of dielectric material having at least a first and a second surface substantially arranged to provide:

three primary apertures extending coaxially from said first and second surfaces and having conductive material disposed on an inner surface of said apertures to provide conductive resonator means, input and output secondary apertures extending coaxially from said first and second surfaces and having conductive material disposed on an inner surface of said secondary apertures to provide conductive resonator means, for at least facilitating external conductive connections and at least allowing desired provision and extraction of electrical signals, wherein the secondary apertures are operably coupled to the primary apertures and the apertures are arranged in an order of:

a first primary aperture, the input secondary aperture, a second primary aperture, the output secondary aperture, and a third primary aperture, a first conductive line is utilized for input into the input of the secondary aperture and a second conductive line is utilized for output from the output secondary aperture, wherein adjacent apertures are at least alternately connected and unconnected to a ground respectively along the first surface and along the second surface such that said conductive resonator means are interdigitated; and conductive material is disposed on at least part of the surfaces of the volume of dielectric material, substantially arranged to at least permit conductive surface mounting of the surface mountable interdigital block filter on the conductive surface of the substrate and to provide an electrical signal filter that provides for selectable frequency rejection response operation wherein the input and output secondary apertures are utilized, respectively, to radiate and receive signals to and from adjacent conductive interdigitated resonator(s) means, wherein said conductive interdigitated resonator means are constructed and arranged such that the block filter has at least a first pole and at least a first zero in its frequency transfer function provided by at least a first resonator that is utilized for zero(s) of a frequency transfer function, and wherein the input and output secondary apertures have a length that is different from the length of the primary apertures.

7. The surface mountable interdigital block filter of claim 6, wherein the conductive material disposed on the dielectric parallelepiped includes at least a wrap-around conductor pattern on at least the first surface of the dielectric parallelepiped and around the input and output secondary apertures at the first surface for facilitating conductive connection of the surface mountable interdigital block filter to the conductive surface of the substrate.

8. The surface mountable interdigital block filter of claim 6, wherein the first surface and the second surface of the parallelepiped of dielectric material are substantially opposing surfaces and wherein each conductive resonator means substantially comprises a resonator whose length extends between first and second surfaces.

9. The surface mountable interdigital block filter of claim 6, wherein the conductive material includes silver.

10. The surface mountable interdigital block filter of claim 6, wherein said first conductive line and said second conductive line are comprised of a first conductor pad and a second conductor pad, respectively, and said first and second conductor pads are located proximate to a radiating end of said input and output secondary apertures, respectively.

11. A surface mountable interdigital block filter in a radio, for utilizing resonators for zero(s) in a frequency transfer function for filtering electrical signals, the block filter being substantially directly mountable on a conductive surface of a substrate, comprising:

a substantially parallelepiped volume of dielectric material having at least a first and a second surface substantially arranged to provide:

five primary apertures extending coaxially from said first and second surfaces and having conductive material disposed on an inner surface of said apertures to provide conductive resonator means, input and output secondary apertures extending coaxially from said first and second surfaces and having conductive material disposed on an inner surface of said secondary apertures to provide conductive resonator means, for at least facilitating external conductive connections and at least allowing desired provision and extraction of electrical signals, wherein the secondary apertures are operably coupled to the primary apertures and the apertures are arranged in an order of:

a first primary aperture, the input secondary aperture, second, third and fourth primary apertures, the output secondary aperture, and a fifth primary aperture, a first conductive line is utilized for input into the input secondary aperture and a second conductive line is utilized for output from the output secondary aperture, wherein adjacent apertures are at least alternately connected and unconnected to a ground respectively along the first surface and along the second surface such that said conductive resonator means are interdigitated, and conductive material is disposed on at least part of the surfaces of the volume of dielectric material, substantially arranged to at least permit conductive surface mounting of the surface mountable interdigital block filter on the conductive surface of the substrate and to provide an electrical signal filter that provides for selectable frequency rejection response operation wherein the input and output secondary apertures are utilized, respectively, to radiate and receive signals to and from adjacent conductive interdigitated resonator(s) means, wherein said conductive interdigitated resonator means are constructed and arranged such that the block filter has at least a first pole and at least two zeroes in its frequency transfer function provided by resonators that are utilized for zero(s) of a freauenov transfer function, and wherein the input and output secondary apertures have a length that is different from the length of the primary apertures.

12. The surface mountable interdigital block filter of claim 11, wherein the conductive material disposed on the dielectric volume includes at least a wrap-around conductor pattern on at least the first surface of the dielectric volume and around the input and output secondary apertures at the first surface for facilitating conductive connection of the surface mountable interdigital block filter to the conductive surface of the substrate.

13. The surface mountable interdigital block filter of claim 11, wherein the first surface and the second surface of the volume of dielectric material are opposing surfaces and wherein each conductive resonator means substantially comprises a resonator whose length extends between first and second surfaces.

14. The surface mountable interdigital block filter of claim 11, wherein the conductive material includes silver.

15. The surface mountable interdigital block filter of claim 11, wherein said first conductive line and said second conductive line are comprised of a first conductor pad and a second conductor pad, respectively, and said first and second conductor pads are located proximate to a radiating end of said input and output secondary apertures, respectively.

* * * * *

UNITED STATES PATENT AND TRADEMARK OFFICE
CERTIFICATE OF CORRECTION

PATENT NO. : 5,327,108

DATED : July 5, 1994

INVENTOR(S) : Truc G.N. Hoang and Darren V. Weninger

It is certified that error appears in the above-identified patent and that said Letters Patent is hereby corrected as shown below:

At column 10, line 31, "freauenov" should be --frequency--.

Signed and Sealed this

Fifteenth Day of November, 1994

*Attest:*

Bruce Lehman

BRUCE LEHMAN

*Attesting Officer*

*Commissioner of Patents and Trademarks*